US006920999B2

(12) United States Patent
Taylor et al.

(10) Patent No.: US 6,920,999 B2
(45) Date of Patent: Jul. 26, 2005

(54) FOLDED SHEET DISPENSER HAVING AN OVERFILL PREVENTION MECHANISM

(75) Inventors: Antwain D. Taylor, Suwanee, GA (US); Victoria L. Bischoff, Roswell, GA (US); Robert C. Ziegenfuss, Stone Mountain, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 88 days.

(21) Appl. No.: 10/283,493

(22) Filed: Oct. 30, 2002

(65) Prior Publication Data

US 2004/0084471 A1 May 6, 2004

(51) Int. Cl.[7] ..... A47F 1/04; G07F 11/00; B65G 59/00; B65H 1/30; B65H 1/00

(52) U.S. Cl. ..... 221/154; 221/281; 221/62; 221/61; 221/286; 221/45; 221/34; 221/46

(58) Field of Search ..... 221/34, 45, 46, 221/61, 62, 154, 281, 286

(56) References Cited

U.S. PATENT DOCUMENTS

| | | | |
|---|---|---|---|
| 1,944,431 | A | 1/1934 | Hope et al. |
| 2,027,674 | A | 1/1936 | Broeren |
| 2,426,787 | A | 9/1947 | O'Neil |
| 3,341,067 | A | 9/1967 | Bastian |
| 3,589,555 | A | 6/1971 | Burkhalter, Jr. |
| 3,935,965 | A | 2/1976 | Stevens |
| 4,469,243 | A | 9/1984 | Ito et al. |
| 4,838,454 | A | 6/1989 | Salzmann et al. |
| 4,938,382 | A | 7/1990 | Frazier et al. |
| 5,076,466 | A | 12/1991 | Petterson et al. |
| 5,716,691 | A | 2/1998 | Chan |
| 5,884,805 | A | 3/1999 | Tramontina |

FOREIGN PATENT DOCUMENTS

| | | |
|---|---|---|
| EP | 0506243 A1 | 9/1992 |
| WO | 9840002 | 9/1998 |

OTHER PUBLICATIONS

U.S. Appl. No. 10/283,691, filed Oct. 30, 2002.

*Primary Examiner*—Donald P. Walsh
*Assistant Examiner*—Michael E Butler
(74) *Attorney, Agent, or Firm*—Dority & Manning

(57) ABSTRACT

A dispenser is provided for dispensing stacked folded sheets. The dispenser includes a housing defining an internal storage space for the stack of sheets. A cover member is pivotally attached to the housing and is movable between an open position and a closed position for loading a stack of folded sheets into the housing. A device, such as a mechanical stop system, is provided and located such that the device must be manually operated with both hands while closing the cover member. In this way, an individual is prevented from using a free hand to compress the stack of folded sheets within the housing.

13 Claims, 7 Drawing Sheets

FOLDED SHEET DISPENSER HAVING AN OVERFILL PREVENTION MECHANISM

TECHNICAL FIELD

The present invention relates to the field of folded sheet dispensers, and more particularly to folded paper product dispensers having an overfill prevention device.

BACKGROUND

Dispensers for dispensing stacked folded sheets of paper towels, tissues, and the, like are well known in the art. Single sheet dispensers are generally desirable because they can be refilled when only partially depleted, as compared to roll product dispensers wherein changing a partially depleted roll may result in significant wasted product. Stacked single sheet dispensers are also desirable because they tend to be simple devices that are not subject to jamming or failure.

A disadvantage of folded stacked sheet dispensers is that they are susceptible to attempts at being overfilled or "stuffed." Overfilling the dispenser can compress the stack of sheets and make it very difficult to remove a sheet from the dispenser. For example, the pressure against the stack may prevent a free tab or end of the sheet from becoming accessible for a user to grasp in order to withdraw the sheet. In an overfilled condition, the stack of sheets may be wedged in the dispenser so firmly that the portion of the sheet grasped by the user simply tears instead of dispensing the sheet. Friction against the dispensing opening may be increased by overfilling the dispenser making dispensing unreliable and problematic.

U.S. Pat. No. 5,884,805 proposes one solution for preventing overfilling of stacked folded sheet dispensers. With the dispenser according to the '805 patent, an overfill bracket is moveably connected to the frame of the dispenser such that an over-capacity of folded sheets in the frame displaces the overfill bracket and prevents the dispenser cover from engaging the frame.

Although the '805 patent provides one solution, it has been found that attempts are still made to overfill dispensers according to the '805 patent by pressing down on the bracket and stack of sheets until the sheets have been compressed enough to allow the cover to latch.

U.S. Pat. No. 4,938,382 discloses a cabinet for dispensing stacked paper sheets having a dynamic mechanism in the cabinet for restricting the height or length of the stack of sheets that can be placed in the cabinet when the cabinet is open. The restricting device is engaged by the cover and moved to a pressure relieving position when the cabinet is closed.

Dispensing cabinets incorporating overstuff protection devices thus generally rely on a movable top-end dynamic device that restricts the height of the stack of sheets that can be loaded into the dispenser. Unfortunately such devices are prone to tampering and destruction resulting from attempts to defeat the device and overstuff the dispenser.

There is still a need in the art for improvements in stacked folded sheet dispensers for preventing overfill conditions. The present invention relates to such an improved dispenser.

SUMMARY

Objects and advantages of the invention will be set forth in part in the following description, or may be obvious from the description, or may be learned through practice of the invention.

According to aspects of the present invention, a dispenser is provided for dispensing stacked folded sheets of paper products, such as paper towels, tissues, and the like. It should be appreciated that the dispenser is not limited by its overall shape or appearance, and that the present invention may be incorporated into any type or configuration of folded sheet dispenser. For example, in one embodiment, the dispenser may be a single dispensing unit configuration. In an alternate embodiment, the dispenser may be a dual dispenser configuration. The dispenser may include any type of aesthetic cover member, housing member, and the like.

The dispenser includes a housing that is configured to hold a supply of stacked folded sheets within an internal storage space. The housing includes a back wall or panel member and a bottom portion that may incorporate at least one dispensing opening defined therein. A cover member is attached to the housing so as to be movable between an open position wherein access is provided to the internal storage space for loading the stacked folded sheets, and a closed position wherein the cover defines a front panel of the dispenser. The dispensing opening may be in the bottom portion of the housing, or in the bottom portion of the cover member.

An overfill prevention device is incorporated with a dispenser according to the invention and is based on the premise that if a technician does not have a free hand available, it will be extremely difficult for he or she to compress the stack of folded sheets while closing the dispenser cover. With most conventional dispensers incorporating some sort of overfill protection device, the device is typically defeated by the technician or other individual manually manipulating the device or compressing the stack of sheets while closing the dispenser cover. Accordingly, the present invention incorporates means for preventing an individual from using a free hand to compress the stack of folded sheets within the internal storage space while moving the cover from its open position to a closed position.

A preventing means can take on any number of devices or mechanisms that must be actuated by the technician or individual using both hands during the closing operation. In one particular embodiment, the preventing means comprises a movable mechanical stop disposed on each side of the dispenser housing. The mechanical stops are disposed relative to the cover and the back member or side walls of the housing to prevent closing of the cover member until the stops are released or actuated by the individual. In one particular embodiment, the stops comprise outwardly biased protruding members. The protruding members may be, for example, spring loaded button devices, resilient tabs, or the like, provided on the side walls of the dispenser housing. The protruding members extend outwardly from the sides of the housing to such an extent that the back edges of the cover member sides engage against the protruding members and prevent the cover from fully closing. The protruding members must be manually depressed by the technician before the cover can be completely closed. So that the technician can still use his hands to close the cover, the protruding members are disposed on the respective back member side walls at a location such that the individual can simultaneously hold the cover and reach and depress a protruding member with each hand.

Desirably, the cover member engages against the stop members at a position just prior to the cover member being fully closed such that even after the stops are depressed, there is insufficient space between the housing back member and the cover member for an individual to insert a hand in an attempt to compress the stack.

The present preventing means is particularly useful in a dispenser configuration wherein the internal storage space comprises an open top. In this configuration, the stacked sheets can only be filled to the extent of the storage space. If additional folded sheets are placed on the stack, the stack will extend above the back member of the housing and the cover is prevented from closing.

It should be appreciated that the unique overfill prevention device according to the present invention may be utilized in any configuration or style of folded sheet dispensers.

The invention will be described in greater detail below with reference to exemplary embodiments of the invention illustrated in the figures.

DETAILED DESCRIPTION

Figure 1:
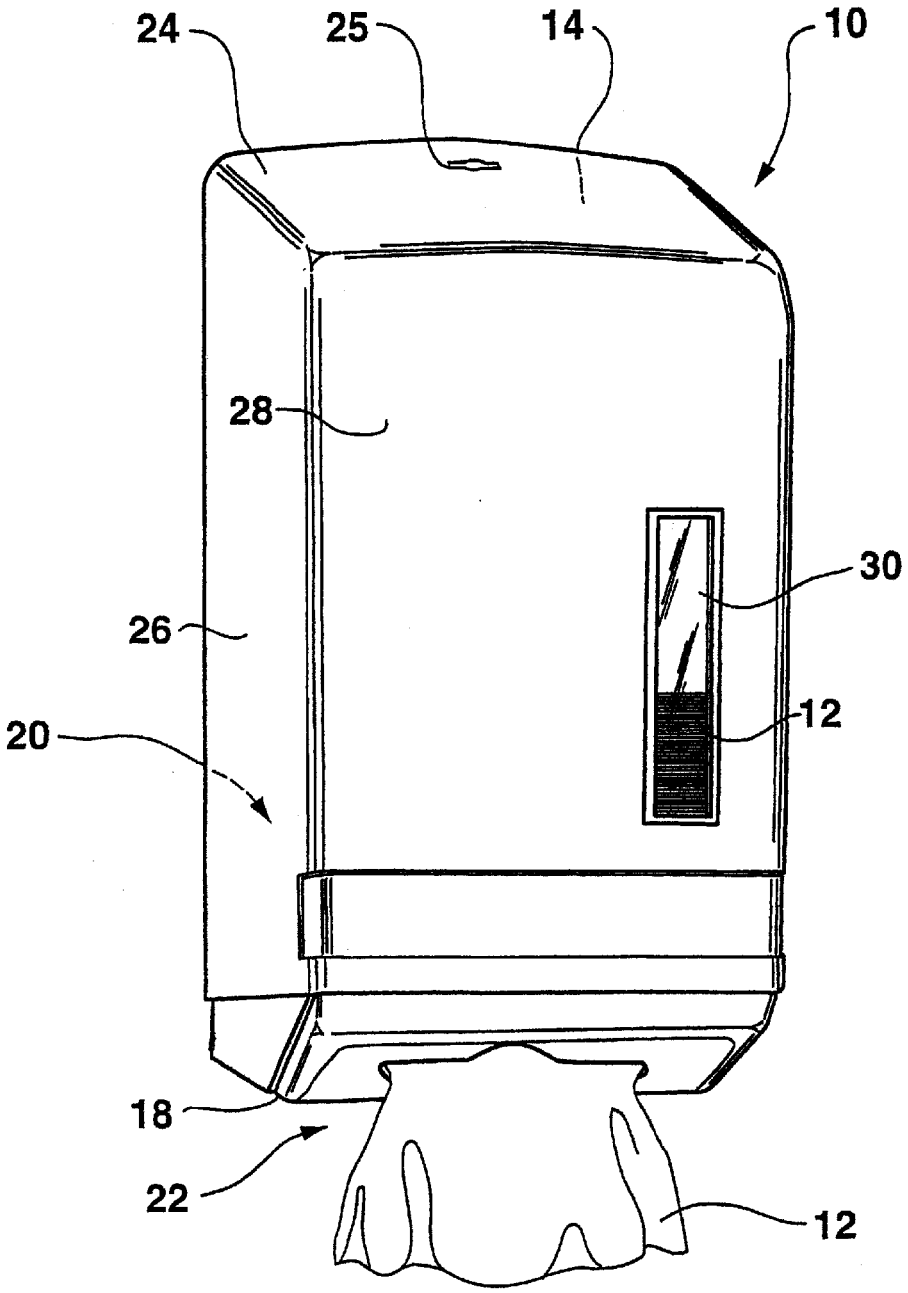
FIG. 1 is a perspective view of a single mode folded sheet dispenser in accordance with the present invention.

Reference will now be made in detail to embodiments of the invention, examples of which are illustrated in the drawings. Each example is provided by way of explanation of the invention, and not as a limitation of the invention. For example, features illustrated or described as part of one embodiment can be used with another embodiment to yield still a further embodiment. It is intended that the present invention include these and other modifications and variations to the embodiments and examples described herein as come within the scope and spirit of the invention.

Referring to the figures in general, a dispenser 10 according to aspects of the invention is illustrated. The dispenser 10 is configured for dispensing stacks of folded individual sheets 12. The dispenser 10 is particularly suited for dispensing paper towels, tissues, and the like. However, it should be appreciated that a dispenser according to the invention is not limited in this regard. The dispenser will be described herein as it relates to a paper towel dispenser for clarity and ease of explanation.

Figure 2:
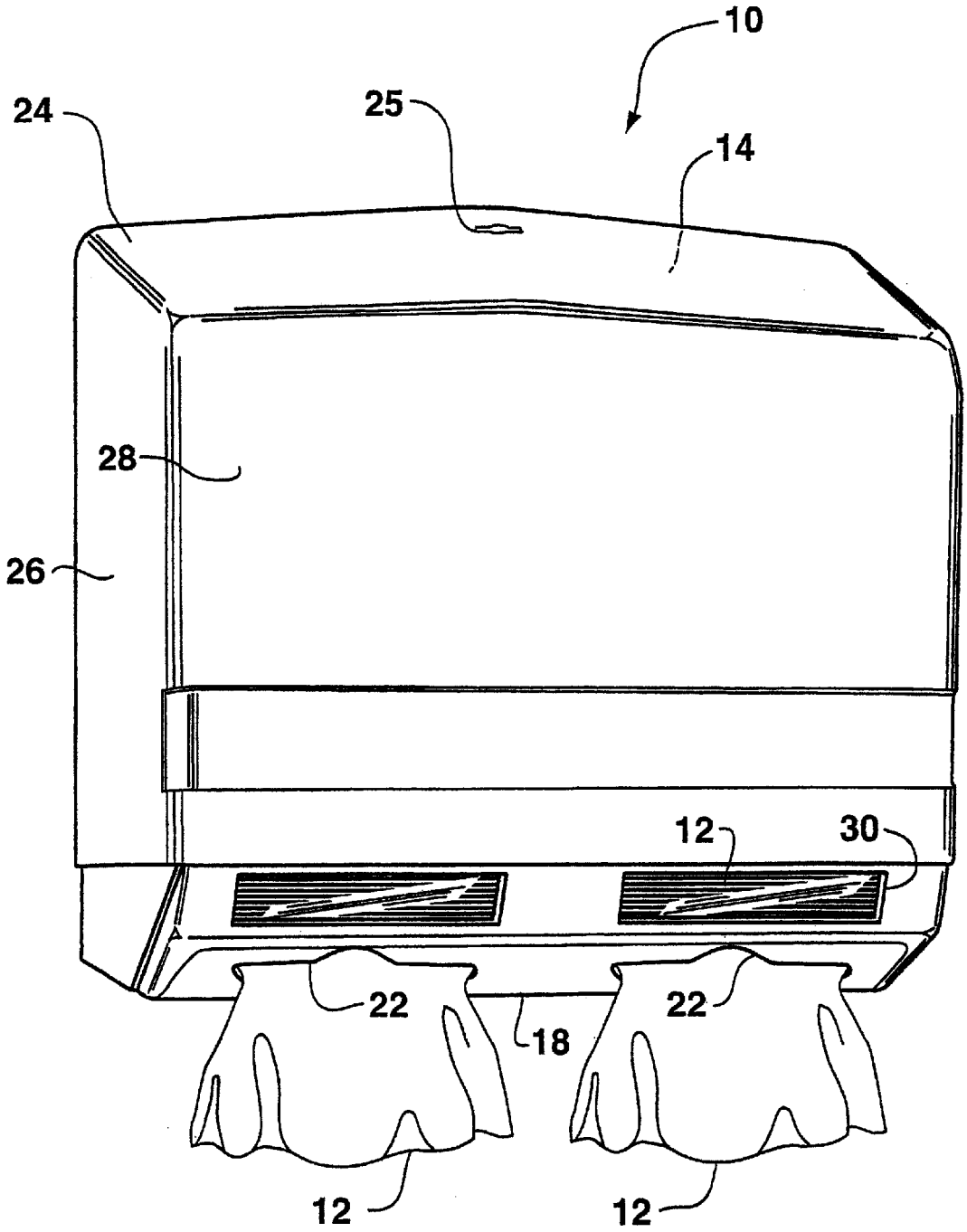
FIG. 2 is a perspective view of a dual mode folded sheet dispenser in accordance with aspects of the present invention.

It should also be appreciated that a dispenser 10 according to the invention is not limited in its overall shape or configuration. For example, the dispenser illustrated in FIG. 1 has the overall shape and configuration of a dispenser provided by Kimberly-Clark Corporation of Neenah, Wis., USA and identified as an INTERLEAVED BATHROOM TISSUE DISPENSER (Item No. 74406). This particular dispenser is a single mode dispenser in that it dispenses a single stack of folded sheets. The illustrative dispenser 10 of FIG. 2 is configured as a dual mode dispenser for dispensing two stacks of folded sheets. A dispenser of this type is available from Kimberly-Clark Corporation and is identified as the SANITOUCH® TWIN INTERLEAVED DISPENSER (Item No. 09012). It should be understood that these particular dispensers are illustrated merely as an example of embodiments of a dispenser that may incorporate the unique features of the present invention.

The dispenser 10 includes a housing 14 that is configured to hold a stacked supply of folded sheets 12 within an internal storage space 20 defined within the housing 14. The housing 14 is typically mounted to a support surface, such as a wall, or the like. The housing 14 may include a stationary back member defining a back wall 16, side walls 17, and a bottom panel or portion 18. A cover 24 is pivotally mounted to the housing 14, for example to the side walls 17. The housing 14 may be formed of any suitable material, including metal, plastic, and so forth. The construction of such dispenser housing units is well known to those skilled in the art and need not be described in great detail herein.

Figure 3:
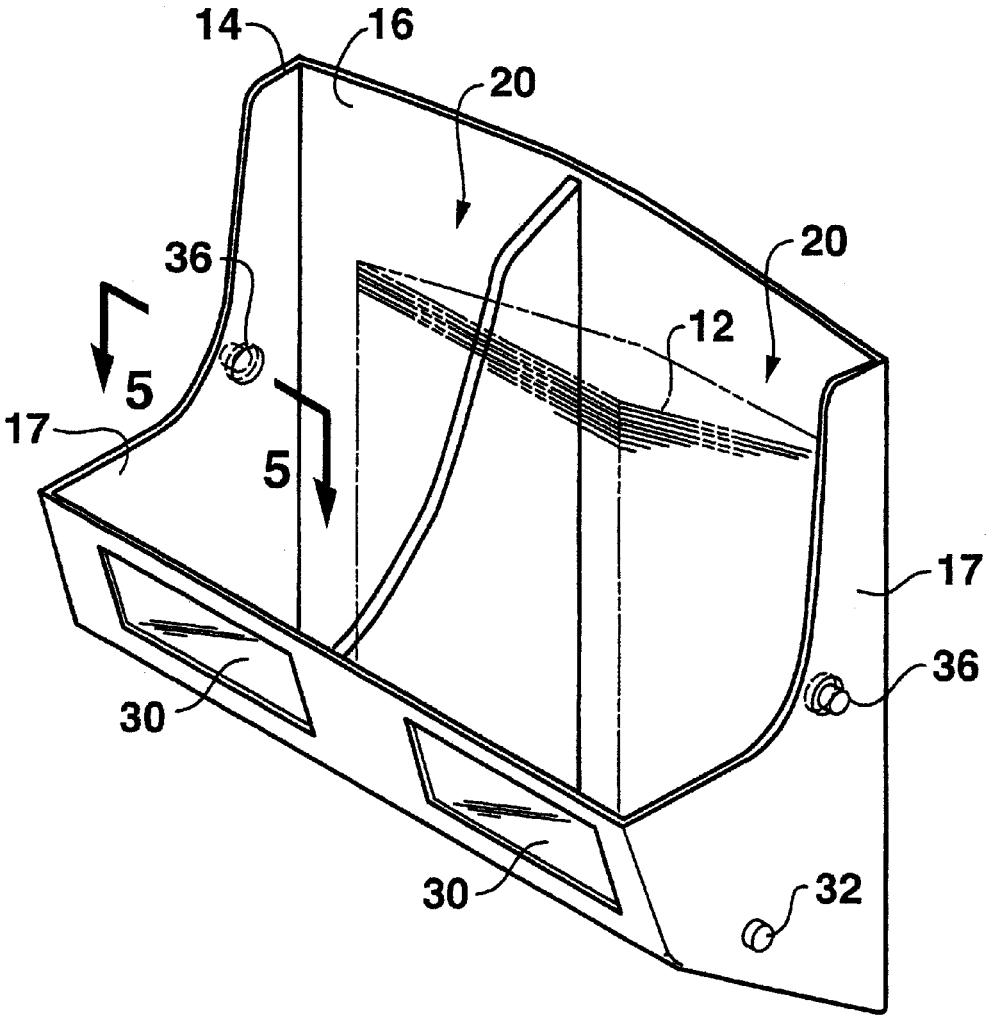
FIG. 3 is a perspective view of the housing back member of a dual mode dispenser according to the invention particularly showing the location of the mechanical stops.
Figure 4A:
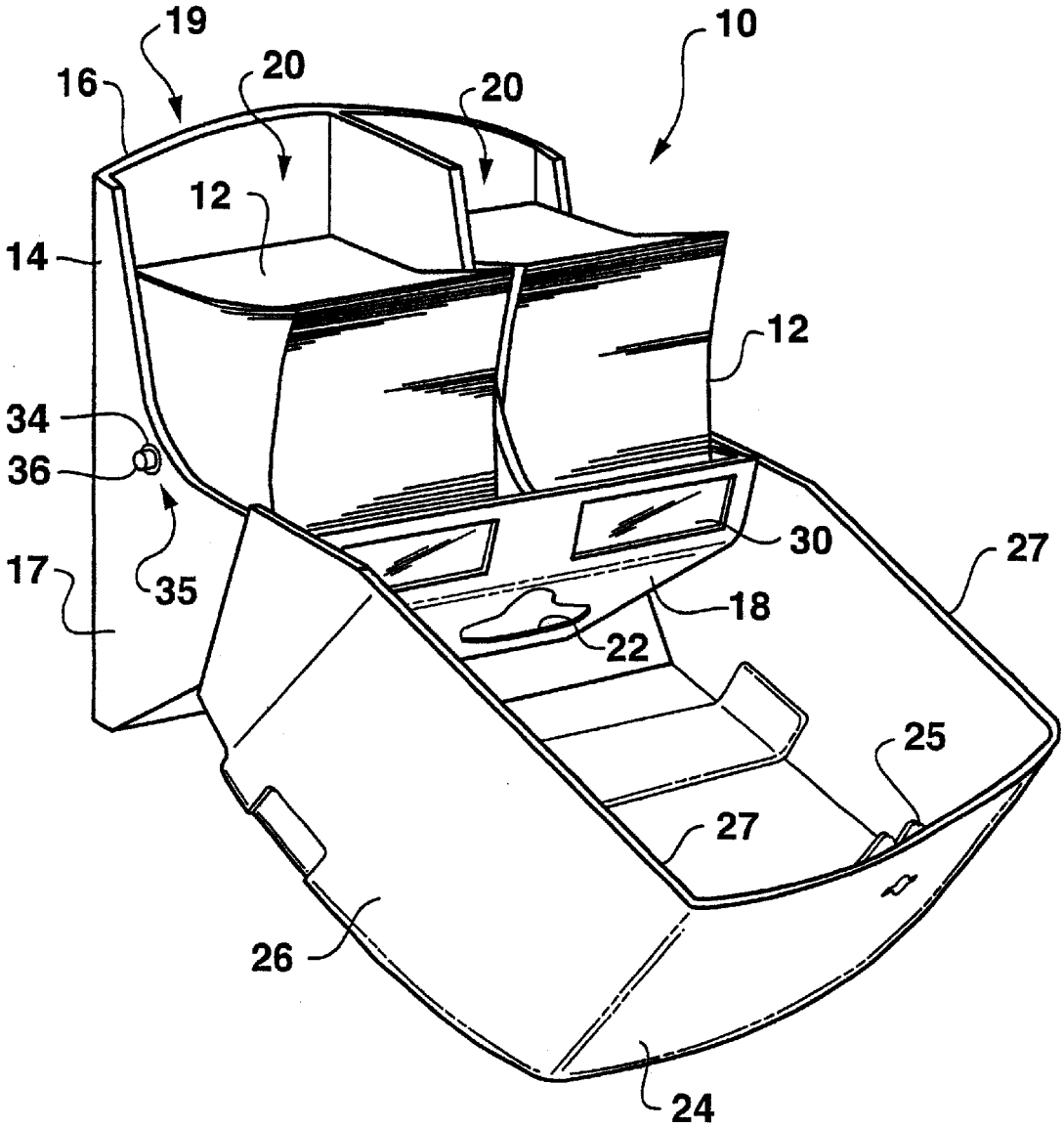
FIG. 4A is a perspective view of a dual mode dispenser shown with the cover member in the open position.
Figure 4B:
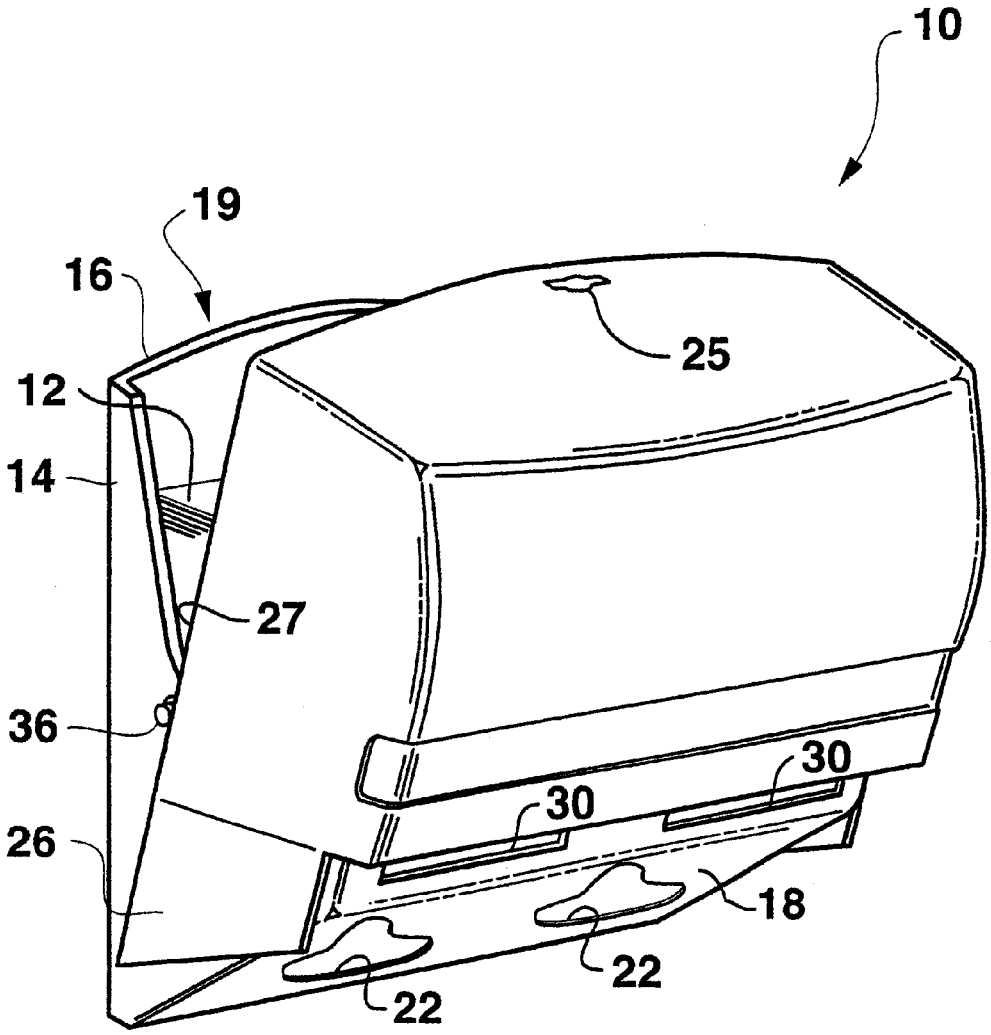
FIG. 4B is a perspective view of the dual mode dispenser shown with the cover member engaged against the mechanical stops when attempting to close the cover member.
Figure 4C:
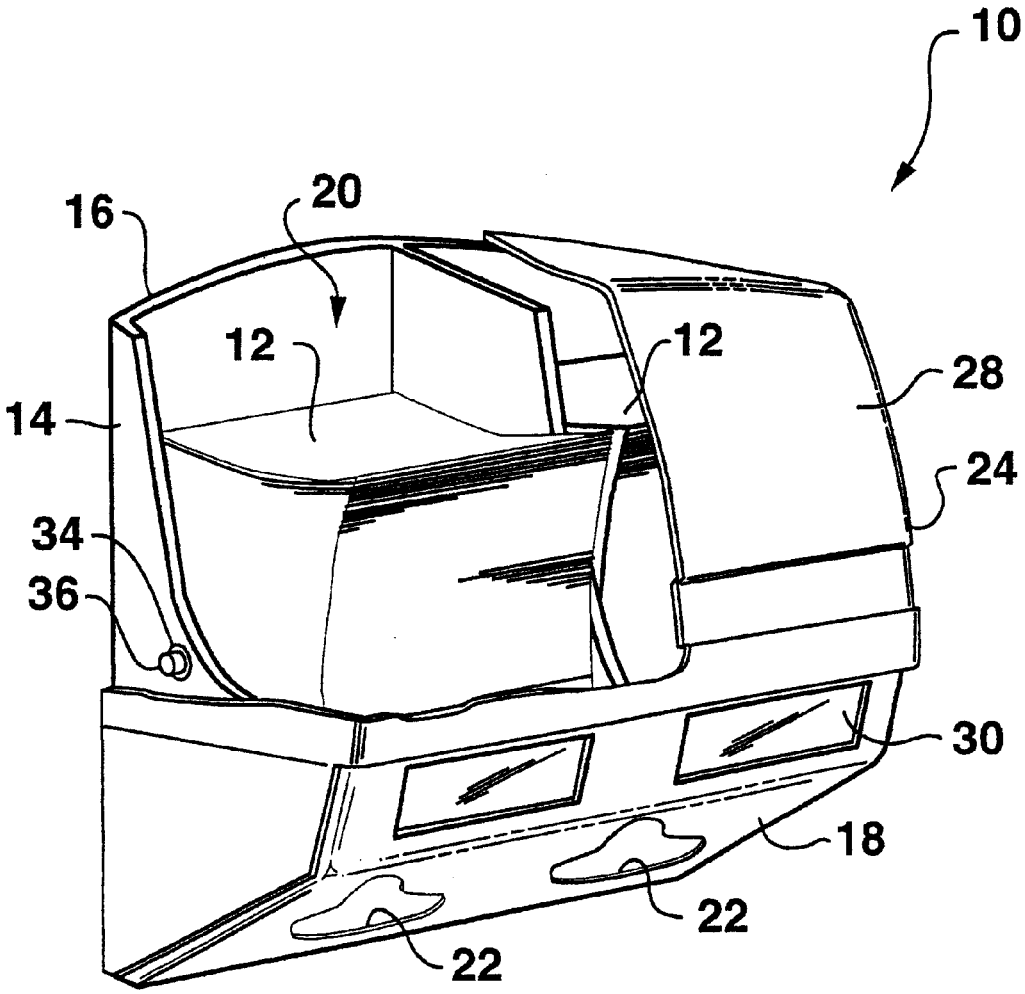
FIG. 4C is a partial cut-away perspective view of the dual mode dispenser shown with the cover in the closed position.

The cover member 24 is movable from a closed position as illustrated in FIG. 4C, to an open position as illustrated in FIG. 4A. In the open position, access is provided to the internal storage space 20 for loading additional folded sheets 12. In its closed position, the cover 24 defines a front panel 28 of the dispenser 10. The cover 24 is pivotally mounted to the housing 14 by any conventional pivotal mounting mechanism 32 (FIG. 3). For example, in the illustrated embodiment, a simple rod or axel member may be provided and retained at location 32. The cover member includes side panels 26 that are rotationally fixed to the rod or axel at location 32. It should be appreciated that any number of conventional pivotal arrangements are known and may be utilized to pivotally mount the cover member 24. The cover 24 is releasably locked to the back panel member 16 of the housing 14 by any conventional locking device 25.

The housing 14 includes at least one dispensing opening 22 through which the folded sheets 12 are dispensed from the internal storage space 20. In the illustrated embodiment, the dispensing opening 22 is defined in the bottom panel 18 of the housing. This is not a limitation of the invention. For example, the dispensing opening could also be defined in a bottom portion or panel member of the cover 24. The dispensing opening 22 may be disposed in any convenient location for a user to pull and dispenser the individual folded sheets 12 from the housing 14.

A window 30 of generally translucent or transparent material may be provided in the housing, particularly in the cover member 24, so that a user or maintenance technician can visibly determine the fill condition of the stack of sheets 12 within the housing 14 without opening the front cover 24.

As mentioned, a dispenser 10 according to the invention includes means for preventing an individual from using a free hand to compress the stack of folded sheets 12 within the internal storage space 20 while moving the cover 24 from its open position to its closed position. The present means are particularly well suited for a dispenser wherein the internal storage space 20 has a generally open top 19. In other words, the height of the stack of sheets 12 is not limited by an internal ceiling, ledge, or the like. The height of the stack is limited by the height of the back wall 16 defining the storage space 20. If additional sheets are placed on the stack, the stack exceeds the height of the back wall 16 and the cover member 24 cannot be closed. The preventing means, generally 32, according to the invention allows the technician to refill the stack of sheets 12 to the top of the back wall 16 defining the storage space 20 while preventing the technician from compressing the stack in order to add additional sheets.

In one particular embodiment of the preventing means illustrated in the figures, the means includes a movable mechanical stop 34 disposed on opposite sides of the housing 14. The mechanical stops 34 are of the type that require manual manipulation by the technician. The mechanical stops 34 are disposed relative to the cover 24 and the side walls 17 of the housing 14 so as to prevent closing of the cover member 24 until the stops 34 are released (e.g. depressed) by the technician.

The stops 34 are disposed on the sides 17 at a location such that back edges 27 of the cover side walls 26 engage against the stops 34 prior to the cover being completely closed, as illustrated in FIG. 4*b*. In order to fully close the cover 24, each of the stops 34 must be manually depressed by the technician. The stops 34 are located along the side walls 17 at a position such that the technician can simultaneously hold the cover and reach and depress the stops 34 with each hand. In other words, the technician may stand in front of and facing the dispenser 10 with one hand on each side of the dispenser. The technician may retain the cover 24 with his thumbs while reaching and depressing the stops 34 with a finger. Once the stops 34 are depressed, the cover can be fully closed.

The stops 34 are also disposed such that once they are released and the cover 24 is free to be fully closed, there is insufficient space between the back edge 27 of the cover side walls 26 and the back wall 16 of the housing 24 for the technician to attempt to insert his hand and compress the stack of sheets 12.

Figure 5:
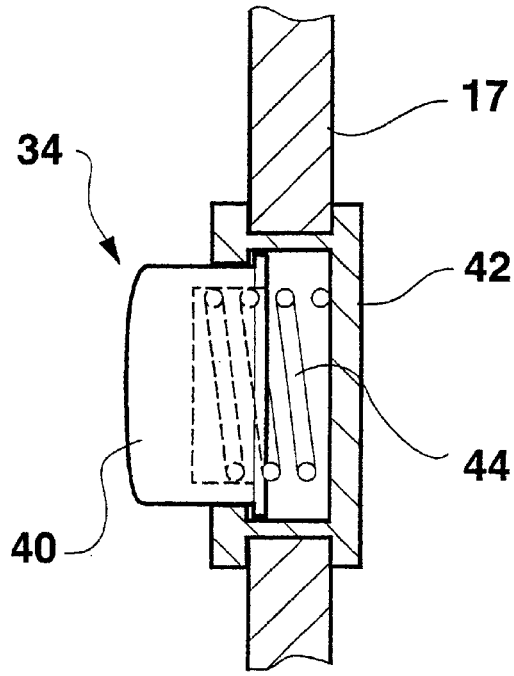
FIG. 5 is a side cut-away view of an embodiment of a stop device according to the invention taken along the lines indicated in FIG. 3.

The stops 34 may take on various configurations. In the illustrated embodiment, the stops comprise outwardly biased protruding members 36. The protruding members 36 are manually depressible by the technician and may include, for example, any manner of spring biased or resilient member. One particular embodiment is illustrated in FIG. 5. In this embodiment, the stop member 34 is a button mechanism wherein a button 40 has a bottom flange residing within a base member 42. A spring 44 is disposed within the base 42 and outwardly biases the button 40. To release the stop, the technician simply presses the button 40 while pushing the cover 24 past the button. The button 40 will extend outwardly upon being released and engage against the inner side of the cover side walls 26, but will not prevent closing of the cover 24. This type of button mechanism may be formed integral with the side walls 17, or may be a separate component attached to the side walls.

Figure 6:
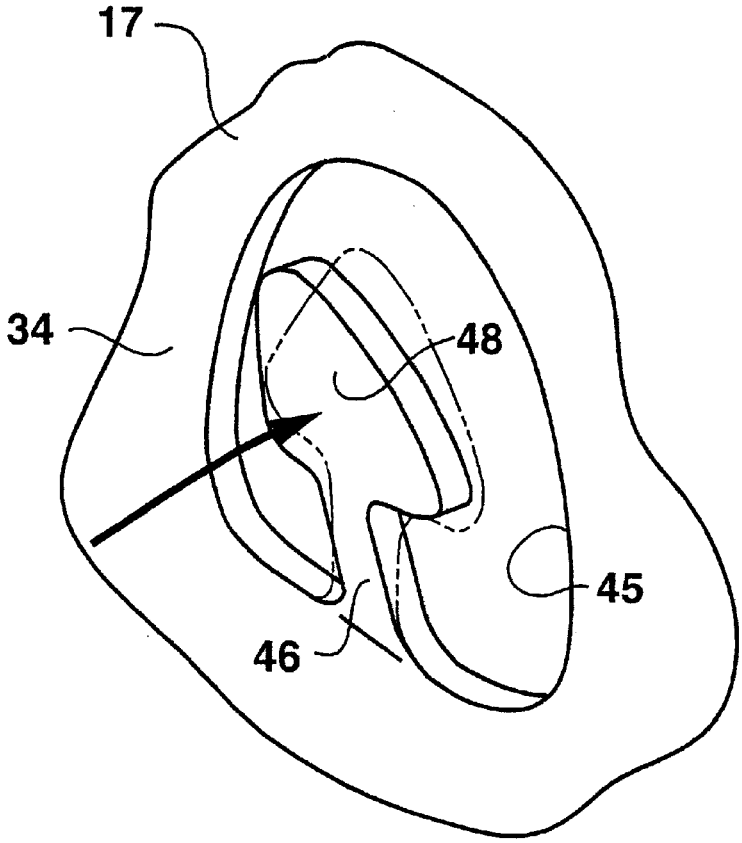
FIG. 6 is a frontal view of an alternative embodiment of a stop device according to the invention.

FIG. 6 illustrates another embodiment of a suitable mechanical stop. In this embodiment, an outwardly protruding head 48 is defined at the end of a resilient finger or tab 46. The finger 46 may be a portion of the side wall 17 of the housing defined by a cutout 45 through the side walls 17.

It should be readily appreciated by those skilled in the art that any manner of manually actuatable device or stop mechanism may be disposed at various locations on the housing 14 that would require the technician to use both hands in a closing operation. For example, such a mechanism may be disposed along the bottom portion 18 of the housing while another is disposed on a top portion of the cover 24 such that the technician must keep one hand essentially under the dispenser 10 while closing the cover 24 with the other hand. All such devices and location of devices are within the scope and spirit of the means for preventing the individual from using a free hand to compress the stack of folded sheets while moving the cover to its closed position. In a particular embodiment of the means, a mechanical stop system as described above is disposed to inhibit closing of the cover 24 until the mechanical stop system is actuated by both hands while closing the cover member 24. The mechanical stop system may include any number and variation of manually actuated device disposed at various locations on the housing and/or cover.

It should thus be appreciated by those skilled in the art that various modifications and variations can be made to the embodiments of the invention described and illustrated herein without departing from the scope and spirit of the invention. It is intended that the invention include such modifications and variations as come within the scope of the appended claims and their equivalents.

What is claimed is:

1. A dispenser for dispensing stacked folded sheets, said dispenser comprising:

a housing configured to hold a stack of folded sheets in an internal storage space;

a cover pivotally attached to said housing and movable between an open position wherein access is provided to said internal storage space for loading folded sheets, and a closed position wherein said cover defines a front panel of said dispenser;

at least one dispensing opening through which folded sheets are dispensed from said internal storage space; and manually actuated means for preventing an individual from using a free hand to compress the stack of folded sheets within said internal storage space while moving said cover from said open position to said closed position.

2. The dispenser as in claim 1, wherein said preventing means comprises movable mechanical stops disposed relative to said cover and said housing to prevent closing of said cover member until said stops are released by the individual.

3. The dispenser as in claim 2, wherein said stops are configured on side walls of said housing and are engaged by side walls of said cover.

4. The dispenser as in claim 3, wherein said stops comprise outwardly biased protruding members, said protruding members being manually depressed by the individual before said cover is closed.

5. The dispenser as in claim 4, wherein said protruding members are disposed on respective said side walls of said housing at a location such that the individual can simultaneously hold said cover and depress one of said protruding members with a single hand.

6. The dispenser as in claim 1, wherein said internal storage space comprises an open top end such that an excess of stacked sheets placed within said storage space prevents closing of said cover.

7. The dispenser as in claim 1, wherein said dispenser is configured as a single mode dispenser with a single said internal storage space and associated said dispensing opening.

8. The dispenser as in claim 1, wherein said dispenser is configured as a dual mode dispenser with two said internal storage spaces and associated said dispensing openings.

9. A dispenser for dispensing stacked folded sheets, said dispenser comprising:

a housing configured to hold a stack of folded sheets in an internal storage space;

a cover pivotally attached to said housing and movable between an open position wherein access is provided to said internal storage space for loading folded sheets, and a closed position wherein said cover defines a front panel of said dispenser;

at least one dispensing opening through which folded sheets are dispensed from said internal storage space; and a manually actuated mechanical stop system disposed to inhibit closing of said cover until actuated by both hands while closing said cover such that an individual does not have a free hand for compressing the stacked sheets within said housing prior to closing said cover.

10. The dispenser as in claim 9, wherein said mechanical stop system is disposed at a location such that the individual actuates said stop system while grasping and closing said cover with both hands.

11. The dispenser as in claim 10, wherein said mechanical stop system comprises stop members disposed on opposite sides of said housing.

12. The dispenser as in claim 11, wherein said stop members comprise depressible protruding members disposed at a height on side walls of said housing such that said stop members are actuated just prior to said cover being closed wherein insufficient space is provided for insertion of a hand into said housing after actuation of said stop members.

13. The dispenser as in claim 12, wherein said stop members comprise spring loaded button members.

* * * * *